US010099349B2

(12) United States Patent
Thompson et al.

(10) Patent No.: US 10,099,349 B2
(45) Date of Patent: Oct. 16, 2018

(54) ELASTIC MEMBER RETENTION DEVICE FOR RATCHET MECHANISM

(71) Applicant: Snap-on Incorporated, Kenosha, WI (US)

(72) Inventors: Christopher Thompson, Franklin, WI (US); Daniel M Eggert, Kenosha, WI (US); Anup A Gupte, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 281 days.

(21) Appl. No.: 14/981,454

(22) Filed: Dec. 28, 2015

(65) Prior Publication Data

US 2016/0214237 A1 Jul. 28, 2016

Related U.S. Application Data

(60) Provisional application No. 62/107,011, filed on Jan. 23, 2015.

(51) Int. Cl.
*B25B 13/46* (2006.01)
*B25B 13/04* (2006.01)

(52) U.S. Cl.
CPC ..... *B25B 13/463* (2013.01); *B25B 13/04* (2013.01)

(58) Field of Classification Search
CPC ..... B25B 13/463; B25B 13/46
See application file for complete search history.

(56) References Cited

U.S. PATENT DOCUMENTS

| | | | | |
|---|---|---|---|---|
| 5,636,557 | A | 6/1997 | Ma | |
| 6,382,051 | B1 | 5/2002 | Chang | |
| 6,481,315 | B1 | 11/2002 | Chang et al. | |
| 6,539,825 | B1 | 4/2003 | Lin | |
| 6,748,825 | B2 * | 6/2004 | Hsu | B25B 13/463 192/41 R |
| 6,807,882 | B2 | 10/2004 | Hu | |
| 6,862,955 | B1 | 3/2005 | Shu-Sui et al. | |
| 6,874,391 | B2 | 4/2005 | Hsien | |
| 6,948,405 | B1 | 9/2005 | Simmons | |

(Continued)

FOREIGN PATENT DOCUMENTS

| | | |
|---|---|---|
| TW | 378588 | 1/2000 |
| TW | 469909 | 12/2001 |

(Continued)

OTHER PUBLICATIONS

Chinese Office Action for Application No. 201610039598.4, dated Sep. 13, 2017, 6 pages.

(Continued)

*Primary Examiner* — David B Thomas
(74) *Attorney, Agent, or Firm* — Seyfarth Shaw LLP

(57) ABSTRACT

A retainer hoop of an elastic member to restrain the elastic member from moving off a hoop spring of a tool, or from moving off a designated portion of the hoop spring. The elastic member can be retained on a portion of the hoop spring by a tube surrounding a portion of the elastic member, or from a bend or combination of bends in the hoop spring itself. The elastic member is therefore restrained from moving to an area where failure can occur more likely if the tool is dropped or if the tool applies a larger load than is conventionally applied.

18 Claims, 4 Drawing Sheets

(56) References Cited

U.S. PATENT DOCUMENTS

| | | | | |
|---|---|---|---|---|
| 7,044,029 | B1 | 5/2006 | Hopper, Jr. et al. | |
| 7,100,477 | B2 | 9/2006 | Lee | |
| 7,178,429 | B2 | 2/2007 | Lin | |
| 8,051,747 | B1 | 11/2011 | Tsai | |
| 8,104,381 | B1 | 1/2012 | Chen | |
| 8,261,635 | B2 | 9/2012 | Lee | |
| 8,661,946 | B2 * | 3/2014 | Lee | B25B 13/463 81/60 |
| 8,943,928 | B2 | 2/2015 | Feng | |
| 9,016,174 | B2 * | 4/2015 | Lee | B25B 13/463 81/60 |
| 2003/0213342 | A1 * | 11/2003 | Wu | B25B 13/463 81/60 |
| 2007/0101832 | A1 | 5/2007 | Lee | |
| 2013/0269488 | A1 | 10/2013 | Huang | |
| 2014/0000415 | A1 | 1/2014 | Lee | |
| 2017/0120425 | A1 * | 5/2017 | Lin | B25B 13/463 |

FOREIGN PATENT DOCUMENTS

| | | |
|---|---|---|
| TW | 519017 | 1/2003 |
| TW | 530721 | 5/2003 |
| TW | 577369 | 2/2004 |
| TW | M250757 | 11/2004 |
| TW | M259673 | 3/2005 |
| TW | M261326 | 4/2005 |
| TW | I235696 | 7/2005 |
| TW | M300596 | 11/2006 |
| TW | M327769 | 3/2008 |
| TW | M347250 | 12/2008 |
| TW | M374386 | 2/2010 |
| TW | M374387 | 2/2010 |
| TW | M374389 | 2/2010 |
| TW | M392043 | 11/2010 |
| TW | M403401 | 5/2011 |
| TW | M409134 | 8/2011 |
| TW | M415026 | 11/2011 |
| TW | M417232 | 12/2011 |
| TW | M423025 | 2/2012 |
| TW | M432503 | 7/2012 |
| TW | 201323157 A | 3/2013 |
| TW | M479826 | 6/2014 |

OTHER PUBLICATIONS

AU Patent Examination Report No. 1 dated Jul. 8, 2016; 7 pages.
Taiwan Office Action dated Aug. 25, 2016; 13 pages.
United Kingdom Intellectual Property Office Combined Search and Examination Report, dated May 11, 2016; 8 pages.
UK Examination Report for Application No. 1601299.9 dated Jun. 29, 2017, 6 pages.
UK Combined Search and Examination Report for Application No. GB1714553.3, dated Mar. 9, 2018, 5 pages.
CN Office Action for Application No. 201610039598.4, dated Mar. 30, 2018, 6 pages.

* cited by examiner

ELASTIC MEMBER RETENTION DEVICE FOR RATCHET MECHANISM

CROSS REFERENCES TO RELATED APPLICATIONS

The present application claims the benefit of U.S. Provisional Patent Application Ser. No. 62/107,011, filed Jan. 23, 2015, entitled Elastic Member Retention Mechanism, the contents of which are incorporated herein by reference in their entirety.

TECHNICAL FIELD OF THE INVENTION

The present invention relates generally to elastic member retention mechanisms. More particularly, the present invention relates to retention mechanisms for pawl springs in ratchet-type devices, such as wrenches.

BACKGROUND OF THE INVENTION

Ratchet tools, such as ratchet wrenches, typically include a pawl and ratchet mechanism that allows relative rotation of the wrench drive in one direction, while preventing relative rotation of the drive in an opposite direction to impart torque to a work piece. These pawl mechanisms include an elastically-biased pawl that has teeth that matingly engage gear teeth in a drive gear to prevent relative rotational movement. The elastic bias is provided by an elastic member, for example a spring, to cause engagement between the pawl and drive gear to effectively prevent rotational movement, thus imparting torque to a work piece.

Conventional elastic members fail or disengage, for example, when the ratchet tool is dropped or when the ratchet tool applies a large amount of torque. This failure typically occurs because the spring is weakly connected to a hoop spring and therefore slips off the hoop spring during use.

SUMMARY OF THE INVENTION

The present invention broadly comprises structures that retain the hoop of the elastic member in place to restrain the elastic member from moving off a hoop spring of the ratchet tool, or from moving off a designated portion of the hoop spring. For example, the elastic member can be retained on a portion of the hoop spring by a tube inserted onto the hoop spring, or from a bend or combination of bends in the hoop spring itself.

An embodiment of the present invention provides a barrier for the hoop of the elastic member such that it is restrained from moving from a designated area to other areas of the hoop spring, which may lead to failure. This creates a more reliable ratchet tool by reducing the possibility of elastic member failure, and improves the capabilities of the ratchet tool by allowing the tool to apply higher loads before failing.

BRIEF DESCRIPTION OF THE DRAWINGS

For the purpose of facilitating an understanding of the subject matter sought to be protected, there are illustrated in the accompanying drawings embodiments thereof, including a preferred embodiment, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
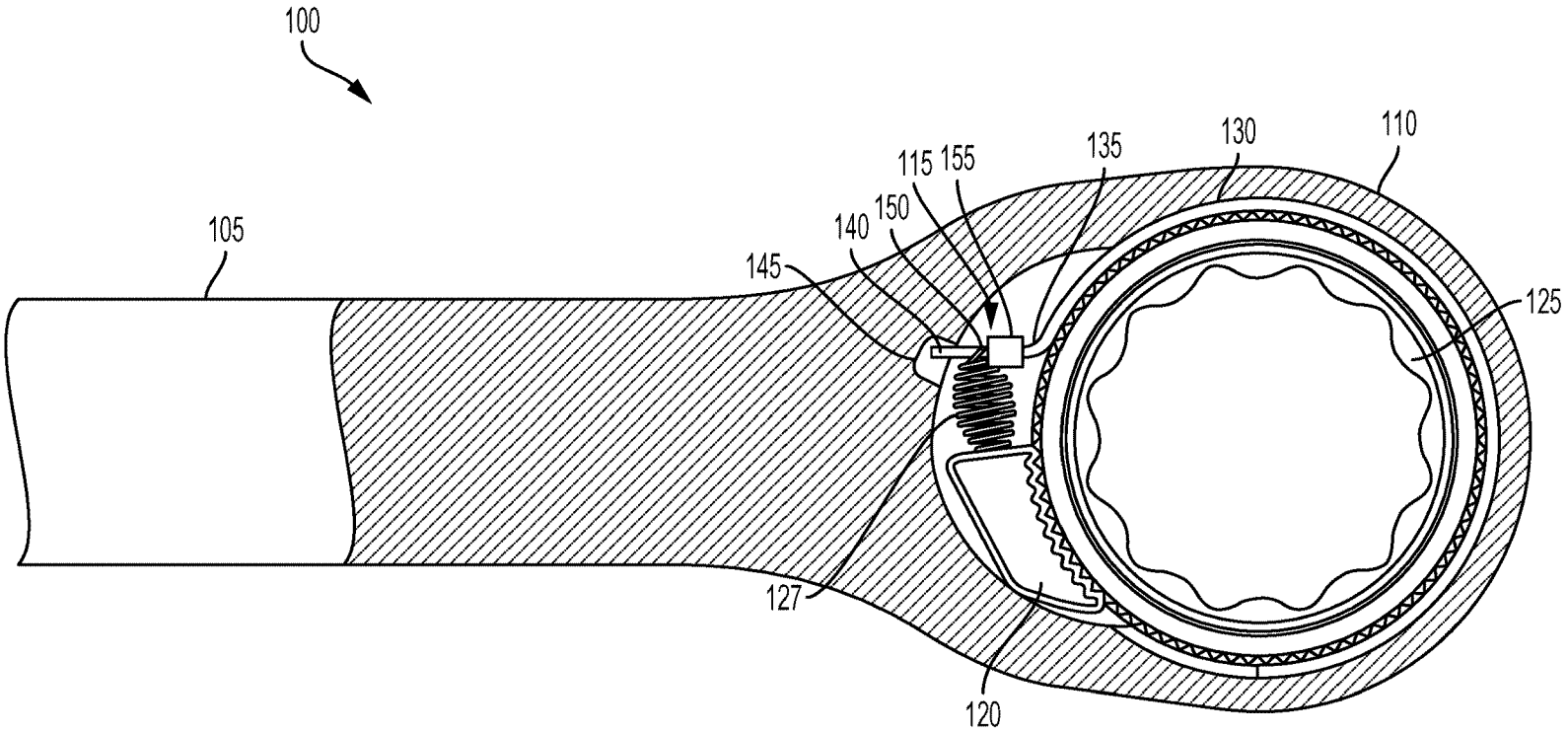
FIG. 1 is a partial, cross sectional view of a tool in accordance with an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the invention, and is not intended to limit the broad aspect of the invention to any specific embodiments illustrated or disclosed. As used herein, the term "present invention" is not intended to limit the scope of the claimed invention, and is instead a term used to discuss exemplary embodiments of the invention for explanatory purposes only.

In an embodiment, the present invention broadly comprises a retention mechanism that restrains an elastic member of a ratcheting tool that includes a ratchet mechanism, such as a ratchet wrench, from sliding off a hoop spring of the tool, or from sliding away from a designated portion of the hoop spring. For example, the retention mechanism can be a tube inserted onto the hoop spring, or a bend or combination of bends in the hoop spring itself. It has been determined that embodiments of the present invention restrain the elastic member from moving from its designated area to other areas of the hoop spring, which may lead to tool failure. The tool is therefore made more reliable and capable by limiting elastic member failure.

Referring to FIG. 1, an embodiment of the tool 100 includes a handle 105 that can be gripped by a user, and is connected to a head 110 adapted to apply torque to a work piece, such as a bolt or nut. The head 110 can include a pawl mechanism 115 having a pawl 120 that selectively meshingly engages a drive gear 125 to substantially permit rotation of the drive gear 125 in a first rotational direction, thus allowing ratcheting in the first rotational direction, and substantially prevent rotation of the drive gear 125 in an opposing second rotational direction, thus imparting torque to a work piece in the second rotational direction. The pawl 120 can be elastically biased to meshingly engage the drive gear 125 by an elastic member 127, and the elastic member 127 can be coupled to the drive gear 125 by a hoop spring 130. The hoop spring 130 can include a bend 135 and an extension portion 140 extending from the bend 135 toward or into an indent. The elastic member 127 can include a hoop 150 coupled to the hoop spring 130 at the extension portion 140 or any other portion of the hoop spring 130. A stop or tube 155 can be coupled to the hoop spring 130 at the extension portion 140, or any other portion, and be adapted to restrain the hoop 150 from slipping or sliding to a portion of the hoop spring 130 that increases the likelihood of failure or unwanted movement of the pawl 120 relative to the drive gear 125.

The handle 105 can be any structure that allows a user to grip the tool 100. The handle 105 can be knurled, textured, indented, or can include a separate grip that helps the user grip the tool 100. The handle 105 need not be rod-like in shape, as shown, and can be a sphere, rectangular prism, or any other shape, and can be hollow, solid, or filled with another material.

The head 110 can likewise be any structure capable of applying any action to a work piece or capable of coupling to any accessory that applies an action to a work piece, for example, a drive lug adapted to couple to a socket to apply torque to a nut or bolt. As shown, the head 110 includes an internal cavity to house the internal components of the tool 100 and is coupled to the handle 105.

The pawl mechanism 115 can be any mechanism capable of permitting rotational movement of the drive gear 125 in a first direction, and substantially preventing rotational movement of the drive gear 125 in a second direction opposite the first direction. The pawl mechanism 115 is shown as a combination of different internal components of the tool 100, for example the pawl 120, elastic member 127, hoop spring 130, and bend 135, but any combination of components or any singular component can act as the pawl mechanism 115.

In some embodiments, the pawl mechanism 115 may also include a reversing lever adapted to select the direction of application of torque to a work piece. For example, the reversing lever may have a first position corresponding to a first torqueing direction and a second position corresponding to a second torqueing direction opposite the first torqueing direction. When the reversing lever is in the first position, the pawl mechanism 115 is adapted to permit rotational movement of the drive gear 125 in the first direction, and substantially prevent rotational movement of the drive gear 125 in the second direction. In contrast, when the reversing lever is in the second position, the pawl mechanism 115 is adapted to permit rotational movement of the drive gear 125 in the second direction, and substantially prevent rotational movement of the drive gear 125 in the first direction.

The pawl 120 can be any structure capable of matingly engaging the drive gear 125 and selectively permitting or preventing rotational movement of the drive gear 125 in the first and second drive directions. As shown, the pawl 120 includes teeth that matingly engage teeth circumferentially disposed on the drive gear 125 to substantially permit rotation of the drive gear 125 in a first direction and prevent rotation of the drive gear 125 in a second direction opposite the first direction. However, the pawl 120 need not include any teeth, and can engage the drive gear 125 through frictional, electrical, magnetic, or any other force to prevent or permit rotation of the drive gear 125. Also, the pawl 120 can be selectively actuated so as to permit or prevent rotation of the drive gear 125 in either of the first and second rotational directions depending on the desire of the user. For example, the user could choose to apply the pawl 120 in a first configuration to prevent rotation of the drive gear 125 in the first rotational direction when driving a work piece to insert the work piece into a working area, or can choose to apply the pawl 120 in a second configuration to prevent rotation of the drive gear 125 in the second rotational direction when removing the work piece from the working area. The pawl 120 can also have intermediate configurations where the drive gear 125 is selectively resisted but not prevented from rotating substantially or completely, and as such, the pawl 120 need not be limited to two rotational configurations.

The drive gear 125 can be any structure capable of applying torque or another tooling operation to a work piece. As shown, the drive gear 125 is a ratchet wrench receiving portion capable of receiving an accessory such as a socket or extension for a socket. However, the drive gear 125 can be a drill chuck, hammer, or any other area capable of receiving any object and/or capable of applying a tooling operation to a work piece or work area.

The elastic member 127 can be any structure capable of applying a biasing force to the pawl 120 so the pawl 120 is biased towards and engages the drive gear 125. As shown, the elastic member 127 is a coil spring, but the elastic member can be a leaf spring, torsion or double torsion spring, tension spring, compression spring, tapered spring, or simply an object elastically biased against the pawl 120. Further, the elastic member 127 need not be a spring at all, or even an elastically biased object, and can be any object that applies an electrical, magnetic, mechanical, or any other type of force to the pawl 120 to bias the pawl 120 toward the drive gear 125. The elastic member 127 can be coupled to the pawl 120 and hoop spring 130 in any manner, or not coupled to the pawl 120 or hoop spring 130 at all.

The hoop spring 130 can be any structure that engages the drive gear 125 or structure surrounding the drive gear 125. As shown, the hoop spring 130 extends around the drive gear 125 in a wrapping orientation, but the hoop spring 130 is not so limited. As shown, the hoop spring 130 includes a bend 135 leading to an extension portion 140 that enters toward, into, or beyond the indent 145. The extension portion 140 can enter into the head 110 or otherwise be coupled to the head 110 within or outside of the indent, or may sit in the indent 145, or can be disposed outside of the indent 145, or can be implemented in any other configuration.

The tube 155 can be any structure that restrains or helps restrain the hoop 150 from sliding or slipping from a preferred orientation to an orientation that is prone to failure. For example, the tube 155 is shown as a cylindrical body that is inserted onto the extension portion 140 between the hoop 150 and the bend 135. The tube 155 therefore restrains the hoop 150 of the elastic member 127 from slipping or sliding toward the drive gear 125 from the extension portion 140, as the elastic member 127 is more likely to fail or not properly work when the hoop 150 is removed from its preferred orientation on the extension portion 140. The tool 100 is therefore sturdier and more reliable, and can tolerate being dropped or applied in high-torque applications because the elastic member 127 can be better secured within its preferred orientation.

Figure 2:
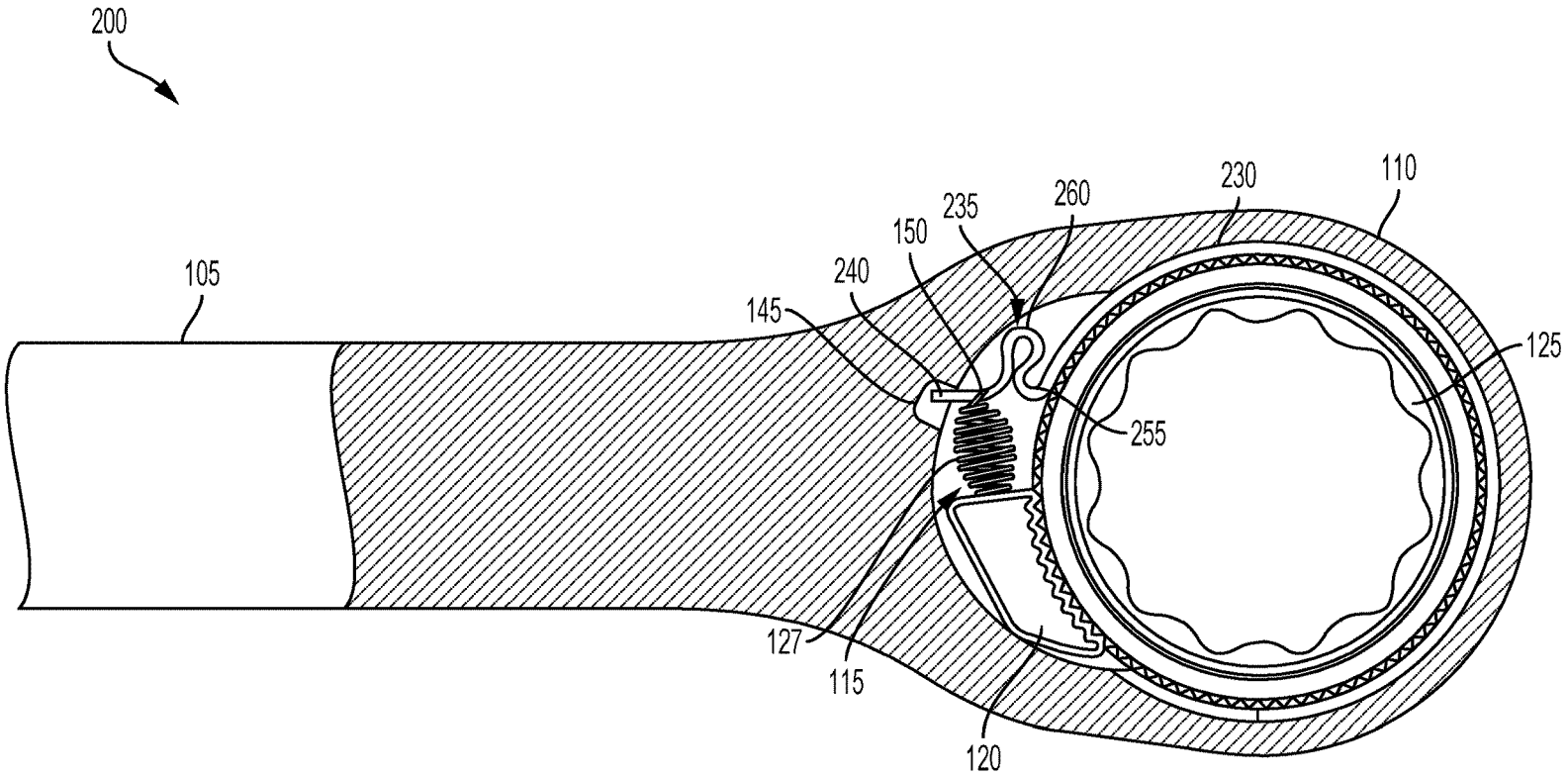
FIG. 2 is a partial, cross sectional view a tool in accordance with another embodiment of the present invention.

Referring to FIG. 2, another embodiment of the present invention of the present invention, with like elements identified by like numerals, is shown. For example, the tool 200 includes the handle 105, head 110, pawl mechanism 115 having the pawl 120 that engages the drive gear 125, elastic member 127, a hoop spring 230, and the indent 145. The tool 200 also includes structure to prevent passage of the hoop 150 from the extension portion 240 towards the drive gear 125, where failure or poor performance is more likely to occur. The tool 200 includes a retention portion 235 that retains the hoop 150 in place on the extension portion 240 or in another preferred orientation. The retention portion 235 can include a modification of the hoop spring 230 near the bend 135, as shown in FIG. 1. Specifically, the retention portion 235 can include a first fold 255 and a second fold 260 that effectively block the hoop 150 from moving from the extension portion 240 toward other areas of the hoop spring 230, for example, near the drive gear 125. The first fold 255 and the second fold 260 provide a barrier by requiring the hoop 150 to travel an additional length around the hoop spring 230, and in a difficult to navigate meandering fashion. In practice, the hoop 150 is not likely to receive the requisite force and direction to travel this additional length and through the meandering retention portion 235, making the retention portion 235 an effective measure at restraining movement of the hoop 150.

The first fold 255 and the second fold 260 can extend in any direction and any number of folds can be implemented without departing from the spirit and scope of the present invention. The intention of the retention portion 235 is simply to modify the hoop spring 130 itself, rather than providing a secondary object to retain the hoop 150 in place, but additional objects can be implemented to perform this feature in conjunction with the retention portion 235. Further, as shown, the retention portion 235 can touch at an intersection of the first fold 255 and the second fold 260 for an additional blocking arrangement, although such a structure is not required.

Figure 3:
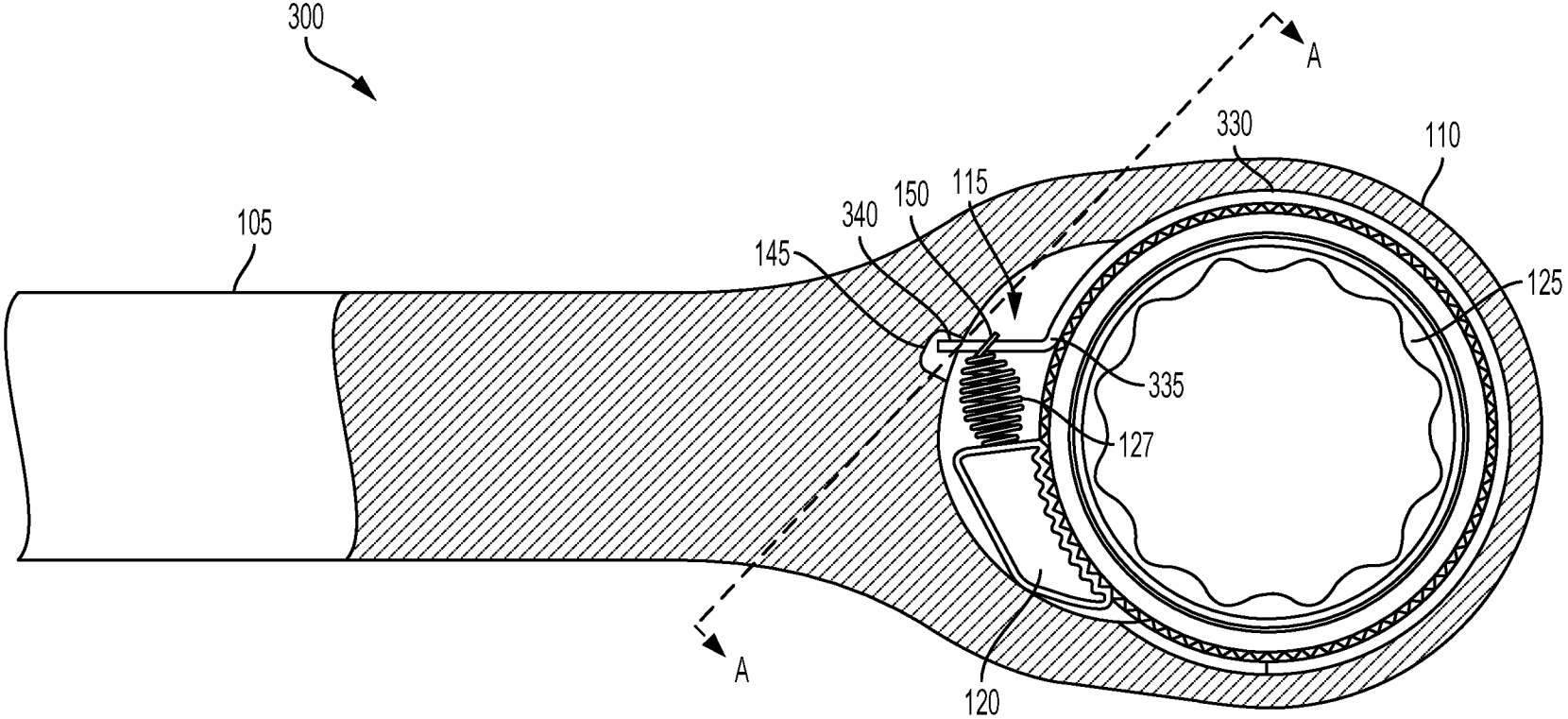
FIG. 3 is a partial, cross sectional view of a tool in accordance with another embodiment of the present invention.
Figure 4:
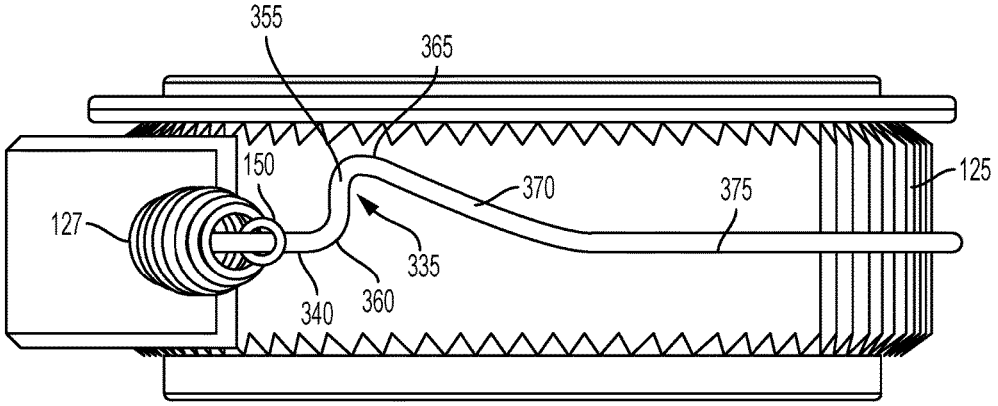
FIG. 4 is a side cross sectional view taken along line A-A of FIG. 3.

Referring to FIGS. 3 and 4, another embodiment of the present invention, with like elements illustrated in like numerals, is shown. For example, the tool 300 includes the handle 105, head 110, pawl mechanism 115 having the pawl 120 that engages the drive gear 125, elastic member 127, a hoop spring 330, and indent 145. As shown, the tool 300 includes a retention portion 335 that can be a modification of the hoop spring 330 itself, rather than a separate object coupled to the hoop spring, as with the tube 155. As shown in FIG. 4, in an embodiment, the retention portion 335 can include a first fold 360 allowing the retention portion 355 to have a first portion 360 extending in a substantially axial direction relative to the drive gear 125. The term "substantially axial" is not intended to limit the direction of the first portion 360 to an absolute straight or axial configuration, but rather is intended to illustrate that the first portion 360 does not extend entirely in a radial direction around the drive gear 125, as other portions of the hoop spring 330 may extend in some embodiments, for example.

The retention portion 335 can also include a second fold 365 extending from the first portion 360 and toward a second portion 370 such that the second portion 370 can extend at an angle to the first portion 360. Like the retention portion 235 in FIG. 2, the retention portion 335 can be designed to be a modification of the hoop spring 330 itself, such that the hoop 150 is restrained from traveling to problematic configurations in which failure or poor performance is more likely. As shown in FIG. 4, the hoop spring 330 can include an extension portion 340 that the elastic member 127 couples to, and that extends in a circumferential direction partially around the hoop spring 330. The second portion 370 of the retention portion 335 can then extend towards a circumferential portion 375 of the hoop spring 330 that continues on a circumferential path around or partially around the drive gear 125. In some embodiments, the circumferential portion 375 can extend circumferentially along an axial center of the drive gear 125, as shown, and can be aligned with the extending portion 340, but departure from this arrangement is within the scope of the present application.

As discussed herein, the pawl 120 of the various embodiments permit rotation of the drive gear 125 in one rotational direction, and substantially prevent rotation of the drive gear 125 in a second direction opposite the first direction. The term "substantially" is intended to illustrate that one of ordinary skill will recognize that no pawl can completely prevent rotation of a drive gear, and that failure or slip will occur at some point. Similarly, one of ordinary will recognize that the drive gear may encounter friction or other such resistance to rotation, and that a pawl cannot completely prevent any such resistance so as to completely permit rotation of the drive gear. Hence, the term "substantially" is used herein to account for such unavoidable realities.

As disclosed herein, the tools 100, 200, and 300 can be a ratchet wrench. However, the tools 100, 200, and 300 can be any tool or object, such as a ratchet wrench, impact wrench, power drill, torque wrench, or any other tool.

The term "coupled," as used herein, is not intended to necessarily mean a direct physical connection but can include an indirect or direct mechanical, electrical, magnetic, or other type of connection.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of Applicant's contribution. The actual scope of the protection sought is intended to be defined in the claims when viewed in their proper perspective based on the prior art.

What is claimed is:

1. A ratcheting tool having a head with a drive gear and a pawl disposed in the head, wherein the pawl is adapted to matingly engage the drive gear to permit rotation of the drive gear, relative to the head, in a first rotational direction, and prevent rotation of the drive gear, relative to the head, in a second rotational direction to apply a torque to a work piece, the tool comprising:

a hoop spring disposed on and at least partially extending around the drive gear;

an elastic member coupled to the hoop spring and adapted to bias the pawl into mating engagement with the drive gear; and a stop disposed on the hoop spring proximate to the elastic member and that is adapted to restrain the elastic member from sliding in a direction towards the drive gear.

2. The tool of claim 1, wherein the elastic member includes a hoop coupled to the hoop spring.

3. The tool of claim 1, wherein the hoop spring includes a bend and an extension portion extending from the bend, and the stop is disposed on the extension portion.

4. The tool of claim 3, wherein the head includes an indent and the extension portion extends into the indent.

5. The tool of claim 3, wherein the stop is disposed on the hoop spring between the elastic member and the bend.

6. The tool of claim 1, wherein the stop is a cylindrical body and is disposed on the hoop spring between the elastic member and the drive gear.

7. The tool of claim 1, where the tool is a ratchet wrench.

8. A ratcheting tool adapted to apply a torque to a work piece, comprising:

a drive gear disposed in a head;

a pawl disposed in the head and adapted to engage the drive gear to permit rotation of the drive gear, relative to the head, in a first rotational direction, and prevent rotation of the drive gear, relative to the head, in an opposing second rotational direction, to apply the torque to the work piece;

a hoop spring disposed on and at least partially extending around the drive gear, the hoop spring includes a retention portion formed in the hoop spring; and an elastic member disposed in the head and coupled to the hoop spring, the elastic member is adapted to bias the pawl into mating engagement with the drive gear;

wherein the retention portion is adapted to restrain the elastic member from sliding in a direction towards the drive gear.

9. The tool of claim 8, wherein the elastic member includes a hoop coupled to the hoop spring.

10. The tool of claim 8, wherein the retention portion includes first and second folds, and the hoop spring includes an extension portion extending from the second fold.

11. The tool of claim 10, wherein the retention portion is disposed between the elastic member and the drive gear.

12. The tool of claim 10, wherein the head includes an indent and the extension portion extends into the indent.

13. The tool of claim 10, wherein the elastic member is coupled to the extension portion.

14. The tool of claim 8, wherein the retention portion includes a first fold forming a first portion extending in a substantially axial direction relative to the drive gear.

15. The tool of claim 14, wherein the retention portion includes a second fold extending from the first portion and forms a second portion extending at an angle relative to the first portion.

16. The tool of claim 15, wherein the retention portion is disposed between the elastic member and the drive gear.

17. The tool of claim 15, wherein the hoop spring includes a circumferential portion extending from the second portion and that continues on a circumferential path at least partially around the drive gear.

18. The tool of claim 8, where the pawl includes teeth adapted to matingly engage the drive gear.

* * * * *